US009917389B2

(12) United States Patent
Markefka

(10) Patent No.: US 9,917,389 B2
(45) Date of Patent: Mar. 13, 2018

(54) FLAT TERMINAL AND SOCKET FOR ELECTRICAL PLUG-AND-SOCKET CONNECTION

(71) Applicant: Erich Jaeger GmbH & Co. KG, Friedberg (DE)

(72) Inventor: Klaus Markefka, Florstadt (DE)

(73) Assignee: Erich Jaeger GmbH & Co. KG, Friedberg (DE)

( * ) Notice: Subject to any disclaimer, the term of this patent is extended or adjusted under 35 U.S.C. 154(b) by 59 days.

(21) Appl. No.: 14/853,679

(22) Filed: Sep. 14, 2015

(65) Prior Publication Data

US 2017/0077634 A1 Mar. 16, 2017

(51) Int. Cl.

| | |
|---|---|
| ***H01R 33/00*** | (2006.01) |
| ***H01R 13/05*** | (2006.01) |
| *H01R 13/52* | (2006.01) |
| *H01R 13/447* | (2006.01) |

(52) U.S. Cl.

CPC ..... *H01R 13/05* (2013.01); *H01R 13/447* (2013.01); *H01R 13/521* (2013.01); *H01R 2201/26* (2013.01); *Y10S 439/936* (2013.01)

(58) Field of Classification Search

CPC ..... H01R 13/052; H01R 13/521; H01R 2201/26; Y10S 439/936

USPC ..... 439/587, 34, 35, 936

See application file for complete search history.

(56) References Cited

U.S. PATENT DOCUMENTS

| | | | | | |
|---|---|---|---|---|---|
| 3,420,087 | A * | 1/1969 | Hatfield | H01R 4/14 | 29/874 |
| 3,644,872 | A * | 2/1972 | Russo, Jr. | H01R 13/115 | 439/849 |
| 3,864,001 | A * | 2/1975 | Millet | B60Q 3/14 | 439/547 |
| 5,593,328 | A * | 1/1997 | Okada | H01R 13/11 | 439/843 |
| 5,707,259 | A * | 1/1998 | Ishizuka | H01R 13/113 | 439/852 |
| 5,800,188 | A * | 9/1998 | Barber | B60D 1/64 | 220/242 |
| 5,873,752 | A * | 2/1999 | Baskin | H01R 13/432 | 439/747 |
| 6,027,377 | A * | 2/2000 | Wang | H01R 24/60 | 439/35 |
| 6,761,597 | B2 * | 7/2004 | Shimizu | H01R 13/11 | 439/748 |
| 7,164,091 | B2 * | 1/2007 | Lu | H01H 1/5805 | 200/292 |

(Continued)

*Primary Examiner* — Tulsidas C Patel
*Assistant Examiner* — Travis Chambers
(74) *Attorney, Agent, or Firm* — McDonnell Boehnen Hulbert & Berghoff LLP

(57) ABSTRACT

A flat terminal for a socket of an electrical plug-and-socket connection comprising: a terminal body formed by a metal strip; a connecting end extending from one of the axial ends of the terminal body; a contacting lug extending from the other of the axial ends of the terminal body, said contacting lug being bent back such that a gap remains between the terminal body and the contacting lug to form a resilient contact surface; and a protection against over-bending protruding into said gap to stop a movement of the contacting lug towards the terminal body in a defined distance from the terminal body.

18 Claims, 2 Drawing Sheets

(56) References Cited

U.S. PATENT DOCUMENTS

| | | | | |
|---|---|---|---|---|
| 7,189,124 | B2 * | 3/2007 | Kobayashi | H01R 13/422<br>439/850 |
| 7,445,481 | B2 * | 11/2008 | Nagashima | H01R 13/521<br>439/276 |
| 8,241,076 | B2 * | 8/2012 | Kubota | H01R 13/113<br>439/852 |
| 9,444,172 | B2 * | 9/2016 | Kawakami | H01R 13/114 |

* cited by examiner

FLAT TERMINAL AND SOCKET FOR ELECTRICAL PLUG-AND-SOCKET CONNECTION

FIELD

The present technology relates to a flat terminal and a socket for an electrical plug-and-socket connection generally used for the electrical interconnection of a tow vehicle or truck and a trailer. Typically, trailers are equipped with cylindrical formed plugs having a central contact terminal surrounded by a number of parameter contact terminals. A well-known standard for such a socket and the related flat contacts is the SAE J2863 standard describing a socket with flat terminals for a plug-and-socket connection. The contact terminals of the plug are wired to the electrical circuit of the trailer and in particular connected to the breaks, turn signals, running signals, and break signals of the trailer. For connecting the trailer to the electrical circuit of the tow vehicle, the socket for connection of the before described plug is mounted typically at the rear end of the tow vehicle which is suited for matching the contact terminals of the plug.

BACKGROUND

A previous type of socket is disclosed in U.S. Pat. No. 5,873,752 describing an electrical connection for a trailer pulled by a vehicle. That patent discloses a unitary socket and contact insert, wherein the contact insert contains flat terminals with elastically bent contact surfaces that are inserted in corresponding openings of the contact support insert. To seal the socket, after the flat terminals are inserted, the plug-in openings are sealed with a liquid sealant. However, during use the contact surfaces of the flat terminals or the flat terminals itself often bend away when a plug is inserted into the socket leading poor electrical contact.

SUMMARY

It is accordingly an object of the present disclosure to provide a flat terminal with a contacting lug porting the contact surface being protected against over-bending.

It is another object of the present disclosure to achieve a flat terminal with higher stiffness.

Another object of the present disclosure is directed to a socket having an improved electrical plug-and-socket connection.

In this regard, the present disclosure proposes a flat terminal for a socket of an electrical plug-and-socket connection generally used for the electrical interconnection of a tow vehicle or truck and a trailer having a terminal body formed by a metal strip; a connecting end extending from one of the axial ends of the terminal body, in particular for contacting connection cables of the tow vehicle leading to the socket; a contacting lug extending from the other of the axial ends of the terminal body, in particular for contacting the contact terminals of a plug inserted into the plug-in opening of the socket, said contacting lug being bent back such that a gap remains between the terminal body and the contacting lug to form a resilient contact surface; and a protection against over-bending protruding into said gap to stop a movement of the contacting lug towards the terminal body in a defined distance from the terminal body.

According to a further aspect of the present disclosure, a socket for use in an electrical plug-and-socket connection is described comprising: a socket housing; a plug-in opening in the socket housing for mating with a plug; a contact support at the bottom of the plug-in opening carrying at least one flat terminal or more flat terminals arranged in a flat terminal assembly; a connection opening in the socket housing disposed on the opposite side of the contact support for connecting a connection cable to the at least one flat terminal; wherein the at least one flat terminal comprises a terminal body formed by a metal strip; a connecting end extending from one of the axial ends of the terminal body and being disposed in the connection opening; a contacting lug extending from the other of the axial ends of the terminal body and being disposed in the plug-in opening, said contacting lug being bent back such that a gap remains between the terminal body and the contacting lug to form a resilient contact surface; and a protection against over-bending protruding into said gap to stop a movement of the contacting lug towards the terminal body in a defined distance from the terminal body.

DETAILED DESCRIPTION

Figure 1:
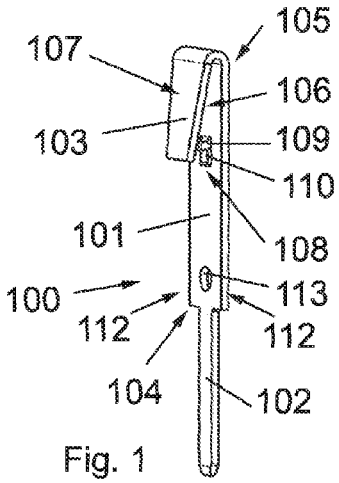
FIG. 1 shows a three-dimensional front side view of a flat terminal of a preferred embodiment.

In the description, flat terminals 100, 200 and 300 for use in a socket 1 of an electrical plug-and-socket connection are shown, e.g. in line with the SAE J2863 standard. Generally, the proposed flat terminal 100, 200, 300 might be used for the electrical interconnection of a tow vehicle or truck and a trailer. However, the use shall not be limited to this preferred example of use. The one skilled in the art will acknowledge that the flat terminal 100, 200, 300 might also be used for other applications asking for stiff flat terminals 100, 200, 300 in a plug-and-socket connection.

The flat terminals 100, 200, 300 shown in FIGS. 1 to 9 comprise a terminal body 101, 201, 301 formed by a metal strip. The metal strip might be flat in its basic form and then be treated with punching and/or bending tools to produce the flat terminals 100, 200 or 300, respectively. Each of the terminals 100, 200, 300 has a connecting end 102, 202, 302 in particular for contacting connection cables (not shown) of the tow vehicle extending to the socket using a plug, soldering, jamming or the like. The connecting end 102, 202, 302 extends from one of the axial ends 104, 204, 304 of the terminal body 101, 201, 301. A contacting lug 103, 203, 303 extends from the other of the axial 105, 205, 305 ends of the terminal body 101, 201, 301, said contacting lug 103, 203, 303 being bent back such that a gap 106, 206, 306 remains between the terminal body 101, 201 and 301 and the contacting lug 103, 203, 303 to form a resilient contact surface 107, 207, 307. The resilient contact surfaces 107, 207, 307 might contact in particular the contacts of a plug (not shown) inserted into a plug-in opening 3 of the socket 1.

Preferably, the connecting end 102, 202, 302 and the contacting lug 103, 203, 303 of each of the flat terminals 100, 200, 300 is integrally formed with the terminal body 101, 201, 301.

Each of the flat terminals 100, 200, 300 has a protection against over-bending 108, 208, 308 of the contacting lug 103, 203, 303 protruding into said gap 106, 206, 306 to stop a movement of the contacting lug 103, 203, 303 towards the terminal body 101, 201, 301 in a defined distance from the terminal body 101. Over-bending causes the contacting lug 103, 203, 303 to leave the elastic range of movement changing permanently and in a non reversible manner the size of the gap 106, 206, 306 between the contacting lug 103, 203, 303 and the terminal body 101, 201, 301. Such bending of the contacting lug 103, 203, 303 might lead to a loose or not reliable connection between the contacts of the socket 1 and plug. The proposed protection against over-bending 108, 208, 308 in line with different embodiments of the proposal is suited to avoid or at least minimize this problems during the daily use.

According to one proposal, the protection against over-bending 108, 208, 308 is formed as a protrusion integrally formed with the plug body 101, 201, 301 and extending therefrom. Also the protrusion is preferably originating form a flat metal strip and being form by a suited punching and/or bending process during manufacturing.

Figure 2:
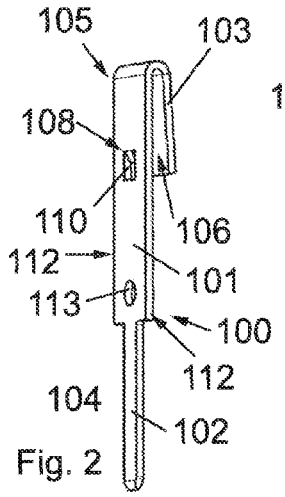
FIG. 2 shows a three-dimensional rear side view of the flat terminal shown in FIG. 1.
Figure 3:
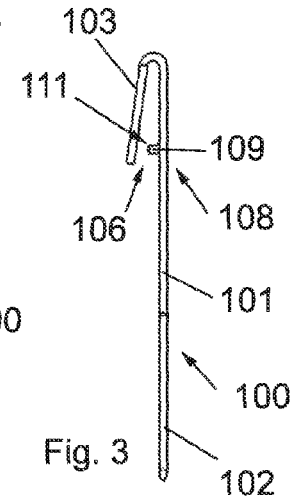
FIG. 3 shows a side view of the flat terminal shown in FIG. 1.

For the flat terminal 100 shown in FIGS. 1 to 3, the protrusion of the protection against over-bending is formed by a bar 109 connected to the terminal body 101 at one end, the bar 109 being preferably shaped by punching out a U-formed area 110 out of the terminal body 101 and bending the resulting bar 109 with its free end into the gap 106. Accordingly, the free end of the bar 109 acts as a fence 111 to stop a movement of the contacting lug 103 towards the terminal body 101 when a force directed towards the terminal body 101 is applied to the resilient contact surface 107.

This proposed bar 109 is a suited measure against over-bending the contacting lug 103. However, during insertion of a plug into the socket, there might occur other forces to the flat terminals of the socket, e.g. if the plug is misaligned to the plug-in opening 3 of the socket.

Figure 4:
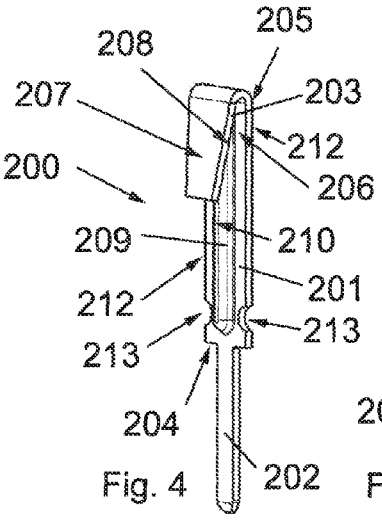
FIG. 4 shows a three-dimensional front side view of a flat terminal of another preferred embodiment.
Figure 5:
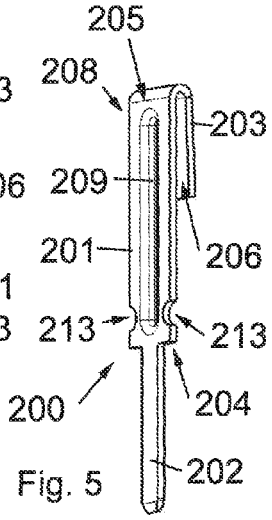
FIG. 5 shows a three-dimensional rear side view of the flat terminal shown in FIG. 4.
Figure 6:
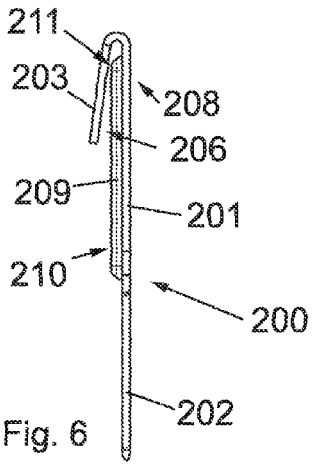
FIG. 6 shows a side view of the flat terminal shown in FIG. 4.

In order to protect not only the contacting lug against over-bending, but also the terminal body against an undesired bending, the flat terminal 200 according to another preferred proposal shown in FIGS. 4 to 6 has as protection against of over-bending a protrusion formed by a ribbing 209 extending in axial direction in the terminal body 201 wherein the ribbing 209 is formed in the terminal body 201 such that the top 210 of the ribbing 209 extending at least partially into the gap 206 between the contacting lug 203 and the terminal body 201. Accordingly, the protruding top 210 of the ribbing 209 disposed in the gap 206 acts as a fence 211 to stop a movement of the contacting lug 203 towards the terminal body 201.

A further aspect of the ribbing 209 as proposed with this embodiment is that the ribbing 209 extending along the axial direction of the terminal body 201 stiffens the (in the basic form flat) terminal body 201 against bending the flat terminal 200 out of shape. Such unwanted bending of the flat terminal 200 might occur when a plug is inserted into the plug-in 3 opening of the socket 1 for contacting the terminals of the socket 1. This might lead to a failure of the electrical plug-and-socket connection and can be avoided with the proposed ribbing 209 due to the local enhancement of the depth of the terminal body 201 in the area of the ribbing 209.

Accordingly, the ribbing 209 has two positive effects: First, the ribbing 209 acts as a fence 211 to stop a movement of the contacting lug 203 towards the terminal body 201, and second, the ribbing 209 enhances the stiffness of the terminal body 201 against bending.

According to a preferred design of this proposal, the ribbing 209 might be formed as a straight line. Of course, other forms of the ribbing 209, such as a wave line or the like, are within the scope of the disclosure of this proposal as each form of a ribbing 209 stiffens the terminal body 201. The one skilled in the art might find the best form of the ribbing 209 depending on the forces that might be applied to the flat terminals 200 during manufacturing and/or use. However, the proposed form of straight line for the ribbing is well suited for flat terminals 200 used in a socket according the SAE J2863 standard.

In order to further enhance the stiffness of the proposed flat terminal 200, the ribbing 209 might extend in axial direction of the flat terminal 200 essentially along the entire length of the terminal body 201. Essentially along the entire length means that there remains only a small edge at the opposing axial ends 204, 205 of the terminal body 201, this small edge towards the axial ends 204, 205 being preferably in the same order as the edges between the ribbing 209 and the lateral end 212.

Another aspect of the proposal to further enhance the stiffness might the ribbing 209 centered between lateral ends 212 of the terminal body 201.

Figure 7:
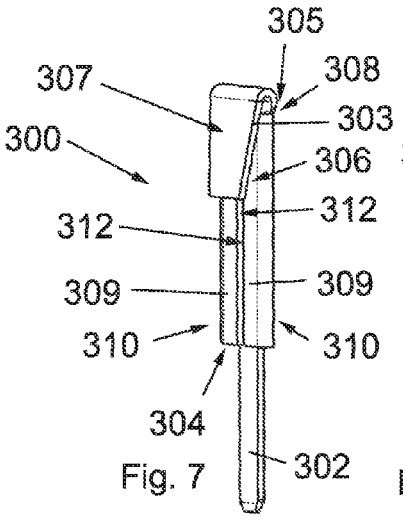
FIG. 7 shows a three-dimensional front side view of a flat terminal of another preferred embodiment.
Figure 8:
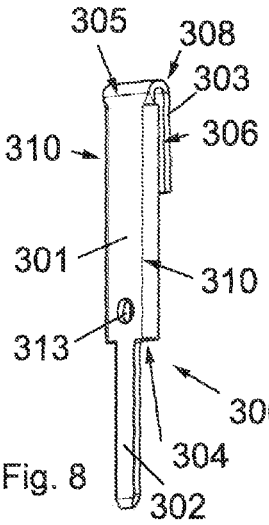
FIG. 8 shows a three-dimensional rear side view of the flat terminal shown in FIG. 7.
Figure 9:
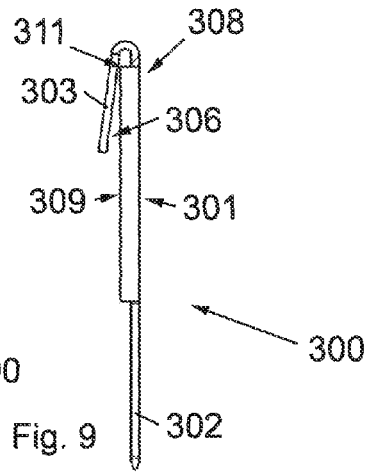
FIG. 9 shows a side view of the flat terminal shown in FIG. 7.

In another proposal according of a flat terminal 300 shown in FIGS. 7 to 9, the protrusion of the protection against over-bending 308 is formed by at least one wing 309, or preferably two wings 309, extending from one of the lateral ends 310 of the plane terminal body 301 bent back towards the terminal body 301 such that the at least one wing 309 is disposed in the gap 306 between the terminal body 301 and the contacting lug 303.

Accordingly, the wing 309 disposed in the gap 306 acts as a fence 311 to stop a movement of the contacting lug 303 towards the terminal body 301, similar to the embodiments described before. Further, the one wing 309 and the terminal body 301 bent or folded towards each other in the described way are forming a V-fold. This V-fold stiffens the (flat) terminal body 301 against bending the flat terminal 300 out of shape. Such unwanted bending of the terminal might occur when a plug is inserted into the plug-in opening 3 of the socket 1 for contacting the terminals of the socket. This might lead to a failure of the electrical plug-and-socket connection and can be avoided with the proposed wing 309 due to the local enhancement of the depth of the terminal body 301 in the area of the wing 309.

Preferably, the at least one wing 309 or each of two wings 309 is extending in axial direction essentially along the entire length of the terminal body 301. This enhances stiffness of the flat terminal 300 along the entire terminal body 301.

Further, the at least one wing 309 or each of two wings 309 might cover about half of the width of the terminal body 301 between its laterals ends 310. Thus, each of the wings 309 is arranged to substantially stiffen the terminal body 301 of the flat terminal 300.

In order to limit the space needed for the wings 309, the at least one wing 309 or the two wings 309 might be directed essentially in parallel to the terminal body 301. Essentially parallel means that the terminal body 301 and preferably each of the wings 309 are arranged in parallel planes within the usual tolerance range.

According to the very preferred arrangement of the flat terminal 300 it might be provided that two wings 309 are provided extending from the opposed lateral ends 310 of the terminal body 301 as shown in the FIGS. 7 to 9. In this arrangement, the stiffness of the flat terminal with the wing-reinforcement is high.

In order to achieve a symmetry of the reinforcement, it is further preferred that the free lateral ends 312 of the two wings 309 are disposed opposing each other along a central axial axis of the terminal body 301. In this arrangement, the two wings 309 folded each towards the terminal body 301 form an open gatefold. Due to the two V-folds of the open gatefold, one along each lateral end 310 of the terminal body 301, the stiffness of the terminal body 301 is enhanced.

For all the embodiments of the flat terminal 100, 200, 300 described before, the contacting lug 103, 203 and 303 is bent such towards the terminal body 101, 201, 301 that the gap 106, 206, 306 between the contacting lug 103, 203, 303 and the terminal body 101, 201, 301 is increasing towards the free end of the contacting lug 103, 203, 303. As a consequence, the contacting lug 103, 203, 303 and the plane terminal body 101, 201, 301 are not directed in parallel. The ensures a better contact to the plug in the elastic range of movement of the bent contacting lug 103, 203, 303.

The width of the contacting lug 103, 203, 303 is preferably reduce towards its free end.

The terminal body 101, 201, 301 of the flat terminal 100, 200, 300 might further contain at least one recess 113, 213, 313 to be filled with sealing or two-component potting compound during mounting of the flat terminal 100, 200, 300 in the socket 1. This enhances the fixing of the flat terminal 100, 200, 300 in the socket 1 while providing contemporaneously a sealing against humidity entering the electrical system of the socket. To this aim, the at least one recess 113, 213, 313 is disposed adjacent to the axial end 104, 204, 304 of the terminal body 101, 201, 301 adjacent to the connecting end 102, 202, 302 of the flat terminal 100, 200, 300.

For the embodiments of the flat terminal 100 and 300, shown in FIGS. 1 to 3 or FIGS. 6 to 9, respectively, the recess 113, 313 might be formed as a circle and disposed within the terminal body 101, 301, in particular centered between the opposing lateral ends 112, 310 of the terminal body 101, 301. Thus, the additional fixing within the sealing or two-component potting compound 9 is centered in the lateral direction, i.e. the direction perpendicular to the central axis of the terminal body 101, 301.

In another embodiment, shown in FIGS. 4 to 6, there might me provided two recesses 213. These to recesses preferably each have the form of a half-circle and are disposed at the opposing lateral ends 212 of the terminal body 201. The arrangement of the recesses 213 in form of a half circle is preferably such that the open diameter of the half circle is aligned with the lateral end or edge 212 of the terminal body. Using two recesses 213 at the lateral ends 212 of the terminal body also ensures a symmetric fixing force within the sealing or two-component potting compound 9. The half-circle recesses 213 are an example for any undercut for stabilizing the terminals in the socket 1. In this embodiment of the flat terminals 200, the recesses 213 might also be omitted as the ribbing 209 forms an undercut itself.

Figure 10:
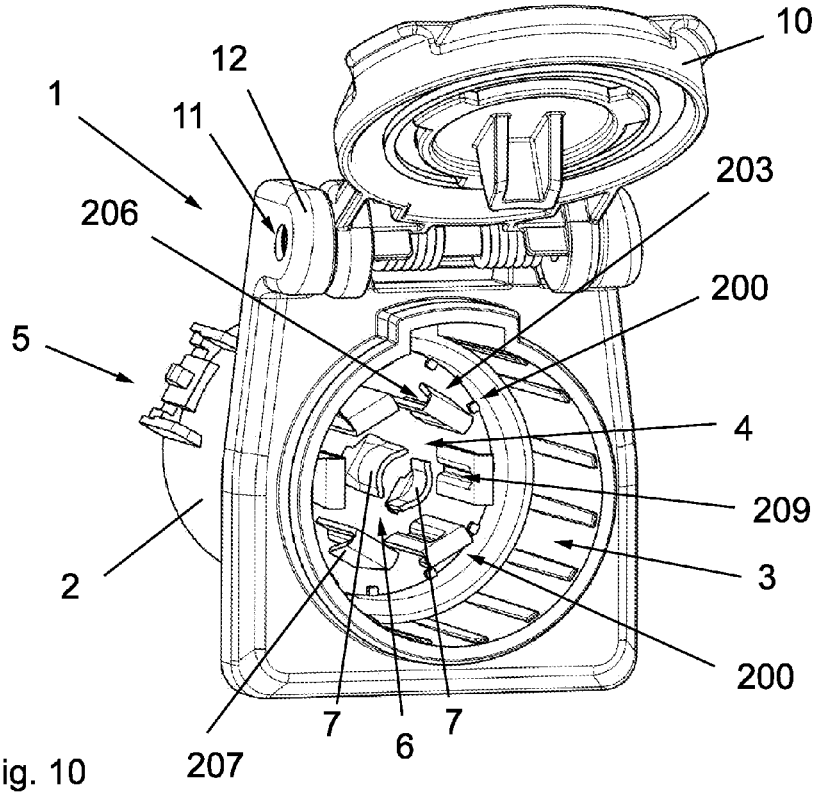
FIG. 10 shows a three-dimensional front side view of a socket of a preferred embodiment.
Figure 11:
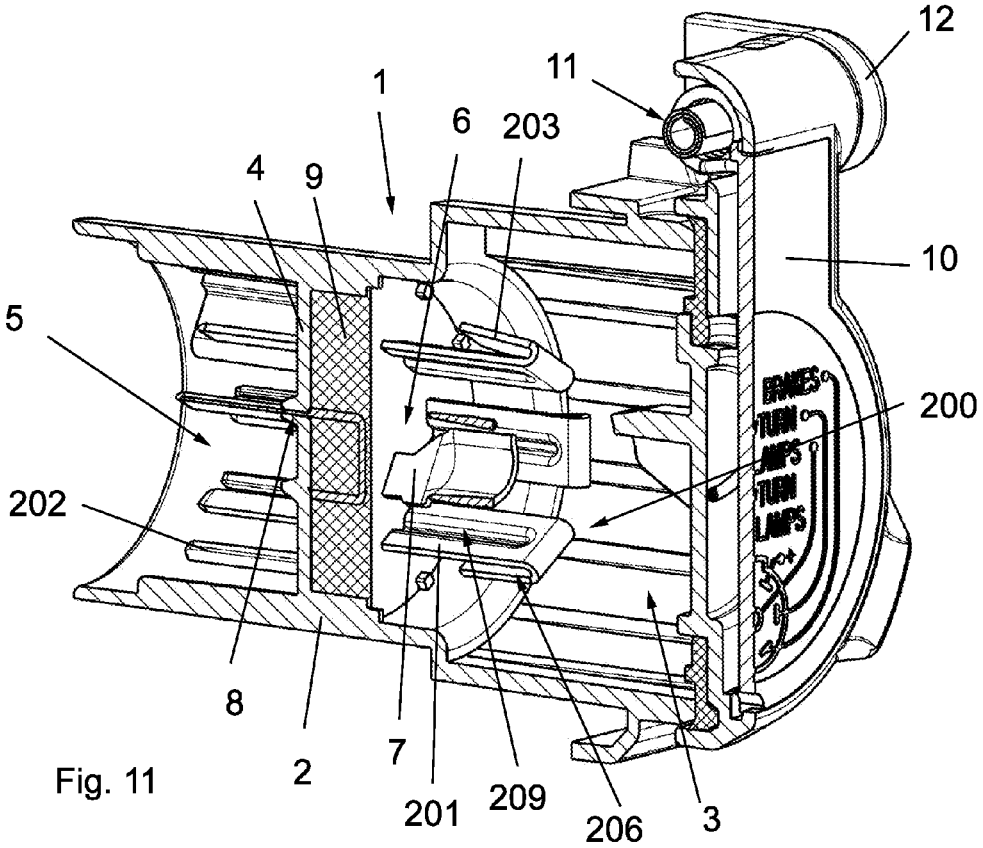
FIG. 11 shows a three-dimensional cross-sectional side view of the socket shown in FIG. 10.

The proposal is further related to a socket 1 for an electrical plug-and-socket connection as shown in the FIGS. 10 and 11. The preferred embodiment shown is a socket 1 according to the SAE J2863 standard. However, even if the proposal is exceedingly useful for such socket 1 according to the SAE J2863 standard, the proposal is not limited to this example.

The proposed socket 1 comprises a socket housing 2, a plug-in opening 3 in the socket housing 1 for mating with a plug (not shown), a contact support 4 at the bottom of the plug-in opening 3 carrying at least one flat terminal 100, 200, 300. In the example shown, a preferred flat terminal 200 having a ribbing 209 is presented. However, the socked according to the proposal might be equipped with any flat terminal according to the current proposal.

Further, the socket 1 comprises a connection opening 5 in the socket housing 2 disposed on the opposite side of the contact support 4 for connecting a connection cable to the at least one flat terminal 200. This might occur via a connection plug (not shown) to be plugged on the connecting ends 202 of the flat terminals and all other terminals, if applicable.

In the example shown, the socket 1 comprises besides several flat terminals 200 in a terminal arrangement described later more in detail one central terminal 6 comprising two curved contact shells 7 disposed such the curved contact shells 7 are facing each other around the central axis of the plug-in opening 3.

The at least one flat terminal 200 of the socket 1 comprises a terminal body 201 formed by a metal strip, a connecting end 202 extending from one of the axial ends 204 of the terminal body 201 and being disposed in the connection opening 5, a contacting lug 203 extending from the other of the axial ends 205 of the terminal body 201 and being disposed in the plug-in opening 3, said contacting lug 203 being bent back such that a gap 206 remains between the terminal body 201 and the contacting lug 203 to form a resilient contact surface 107. The flat terminal 200 further comprises a protection against over-bending 208 protruding into said gap 206 to stop a movement of the contacting lug 203 towards the terminal body 201 in a defined distance from the terminal body 201.

It is evident to the one skilled in the art, that the proposed socket 1 can be equipped with a flat terminal 200 have some or all of the features described before for this embodiment. Further, instead of flat terminal 200, the proposed socket 1 might also be equipped with flat terminals 100, 300 as described before comprising some or all of the features described before for these embodiment. Following, the socket 1 will be described by way of example with the flat terminals 200.

The socket 1 shown in FIGS. 10 and 11 has six flat terminals 200 arranged in a circular array around the central axis of the plug-in opening 3 wherein the contacting lugs 203 of the flat terminals 200 are directed outwardly of the circular array towards the socket housing 2 surrounding the plug-in opening 3. In this arrangement, the resilient contact surfaces 207 of the contacting lugs 203 are disposed according the SAE J2863 standard for mating with the respective plugs.

It is to be emphasized that all of the proposed flat terminals 100, 200, 300 meet the dimension requirements of the SAE J2863 standard irrespective of the reinforced structure of the terminal bodies 101, 201, 301 with the additional protection against over-bending 108, 208, 308. In case of the flat terminals 200, 300, this protection against over-bending 208, 308 further significantly stiffens the terminal body 201, 301 against bending while still keeping the dimension requirements of the SAE J2863 standard.

As best seen in the cross sectional view of FIG. 11 of the proposed socket 1, the contact support 4 fixes the terminals 6, 200 by simply pushing-in the terminals 6, 200 in fixing openings 8 in the contact support 4 adapted to the form of the respective terminals 6, 200. After pushing-in the terminals 6, 200 during assembly of the socket, a sealing or two-component potting compound 9 might be provided covering the entire bottom of the plug-in opening 3 formed by the contact support 4, wherein the sealing compound 9 encompasses the flat terminals 200 (and the central termial 6) carried in the contact support 4. As evident, the sealing or two-component potting compound 9 is also entering the recesses 213 in the flat terminals thus enhancing the fixing of the terminals in the contact support 4. The sealing or two-component potting compound 2 is very steady after hardening.

In order to protect the plug-in opening 3 of the socket 1, there might be provided a socket cover 10 for water-tightly closing the plug-in opening 3, the socket cover 10 being hinged to the socket housing 2 around a hinge axis 11 supported in a flange 12. FIG. 10 shows the socket cover 10 hinged away from the plug-in opening 3 ready for plugging-in a plug (not shown). In FIG. 11, the socked cover 10 is closed sealing or protecting the plug-in opening 3 against the entry of dirt and water.

The description of the different advantageous arrangements has been presented for purposes of illustration and description, and is not intended to be exhaustive or limited to the examples in the form disclosed. Many modifications and variations will be apparent to those of ordinary skill in the art. Further, different advantageous examples may provide different advantages as compared to other advantageous examples. The example or examples selected are chosen and described in order to best explain the principles of the examples, the practical application, and to enable others of ordinary skill in the art to understand the disclosure for various examples with various modifications as are suited to the particular use contemplated.

LIST OF REFERENCE NUMBERS 1 socket
2 socket-housing
3 plug-in opening
4 contact support
5 connection opening
6 central terminal
7 curved contact shell
8 fixing openings
9 sealing or two-component potting compound
10 socket cover
11 hinge axis
12 flange
100 flat terminal
101 terminal body
102 connecting end
103 contacting lug
104 axial end of the terminal body towards connecting end
105 axial end of the terminal body towards contacting lug
106 gap
107 resilient contact surface
108 protection against over-bending
109 bar
110 punched out U-form area
111 fence
112 lateral end
113 recess
200 flat terminal
201 terminal body
202 connecting end
203 contacting lug
204 axial end of the terminal body towards connecting end
205 axial end of the terminal body towards contacting lug
206 gap
207 resilient contact surface
208 protection against over-bending
209 ribbing
210 top of the ribbing
211 fence
212 lateral end
213 recess
300 flat terminal
301 terminal body
302 connecting end
303 contacting lug
304 axial end of the terminal body towards connecting end
305 axial end of the terminal body towards contacting lug
306 gap
307 resilient contact surface
308 protection against over-bending
309 wing
310 lateral end
311 fence
312 free lateral end of the wing
313 recess

What is claimed is:

1. A flat terminal for a socket of an electrical plug-and-socket connection comprising:

a terminal body formed by a metal strip;

a connecting end extending from one of the axial ends of the terminal body;

a contacting lug extending from the other of the axial ends of the terminal body, said contacting lug being bent back such that a gap remains between the terminal body and the contacting lug to form a resilient contact surface; and a protection against over-bending protruding into said gap to stop a movement of the contacting lug towards the terminal body in a defined distance from the terminal body, said protection being formed as a protrusion integrally formed with the plug body and extending therefrom;

wherein the protrusion is formed by a ribbing extending in axial direction along the almost entire length of the terminal body and centered between lateral ends of the terminal body; and wherein the ribbing is formed in the terminal body such that the top of the ribbing extending into the gap between the contacting lug and the terminal body.

2. The flat terminal according to claim 1 wherein the ribbing is formed as a straight line.

3. The flat terminal according to claim 1 wherein the terminal body contains at least one recess to be filled with sealing compound during mounting of the flat terminal in the socket.

4. The flat terminal according to claim 3 wherein the at least one recess is disposed adjacent to the axial end of the terminal body adjacent to the connecting end of the flat terminal.

5. The flat terminal according to claim 3 wherein the recess is formed as a circle, rectangle or any other closed hole, and disposed within the terminal body.

6. The flat terminal according to claim 3 wherein two recesses are provided each having the form of a half-circle, rectangle, triangle or any other kind of a undercut, and disposed at the opposing lateral ends of the terminal body.

7. The flat terminal according to claim 1 wherein the contacting lug is bent such towards the terminal body that the gap between the contacting lug and the terminal body is increasing towards the free end of the contacting lug.

8. The flat terminal according to claim 7 wherein the contacting lug and the terminal body are not directed in parallel.

9. A socket for an electrical plug-and-socket connection, comprising:

a socket housing;

a plug-in opening in the socket housing for mating with a plug;

a contact support at the bottom of the plug-in opening carrying at least one flat terminal;

a connection opening in the socket housing disposed on the opposite side of the contact support for connecting a connection cable to the at least one flat terminal;

wherein the at least one flat terminal comprises:

a terminal body formed by a metal strip;

a connecting end extending from one of the axial ends of the terminal body and being disposed in the connection opening;

a contacting lug extending from the other of the axial ends of the terminal body and being disposed in the plug-in opening, said contacting lug being bent back such that a gap remains between the terminal body and the contacting lug to form a resilient contact surface; and a protection against over-bending protruding into said gap to stop a movement of the contacting lug towards the terminal body in a defined distance from the terminal body, said protection being formed as a protrusion integrally formed with the plug body and extending therefrom wherein said protrusion is formed by a ribbing extending in axial direction along the almost entire length of the terminal body and centered between lateral ends of the terminal body; and wherein the ribbing is formed in the terminal body such that the top of the ribbing extending into the gap between the contacting lug and the terminal body.

10. The socket according to claim 9 wherein the socket comprises a socket cover for closing the plug-in opening, the socket cover being hinged to the socket housing around a hinge axis supported in a flange.

11. The socket according to claim 9 wherein the contact support at the bottom of the plug-in opening is covered with a sealing compound wherein the sealing compound encompasses the at least one flat terminal carried in the contact support.

12. The socket according to claim 9 wherein six flat terminals are arranged in a circular array around the central axis of the plug-in opening wherein the contacting lugs of the flat terminals are directed outwardly of the circular array towards the socket housing surrounding the plug-in opening.

13. The socket according to claim 9 wherein the ribbing is formed as a straight line.

14. The socket according to claim 9 wherein the contacting lug is bent such towards the terminal body that the gap between the contacting lug and the terminal body is increasing towards the free end of the contacting lug.

15. The socket according to claim 9 wherein the terminal body contains at least one recess to be filled with sealing compound during mounting of the flat terminal in the socket.

16. The socket according to claim 15 wherein the at least one recess is disposed adjacent to the axial end of the terminal body adjacent to the connecting end of the flat terminal.

17. The socket according to claim 15 wherein the recess is formed as a circle, rectangle or any other closed hole, and disposed within the terminal body.

18. The socket according to claim 15 wherein two recesses are provided each having the form of a half-circle, rectangle, triangle or any other kind of a undercut, and being disposed at the opposing lateral ends of the terminal body.

* * * * *